United States Patent [19]

Coulon

[11] Patent Number: 4,795,313

[45] Date of Patent: Jan. 3, 1989

[54] PROTECTIVE TIP FOR A TITANIUM BLADE AND A METHOD OF BRAZING SUCH A TIP

[75] Inventor: André Coulon, Bessoncourt, France

[73] Assignee: Alsthom, Paris, France

[21] Appl. No.: 54,926

[22] Filed: May 28, 1987

[30] Foreign Application Priority Data

May 28, 1986 [FR] France ..... 86 07661

[51] Int. Cl.[4] ..... F01D 5/28; C23C 7/00

[52] U.S. Cl. ..... 416/224; 416/241 R; 228/263.21; 29/156.8 B

[58] Field of Search ..... 416/213 R, 224, 241 R; 415/200, 214; 29/156.8 B; 228/263.21, 231; 420/417, 421

[56] References Cited

U.S. PATENT DOCUMENTS

| | | | |
|---|---|---|---|
| 2,661,286 | 12/1953 | Swazy et al. | 420/417 |
| 2,664,355 | 12/1953 | Craighead | 420/417 |
| 2,714,245 | 8/1955 | Goetzel | 29/156.8 B |
| 2,903,785 | 9/1959 | Hanink et al. | 29/156.8 B |
| 3,561,886 | 2/1971 | Kreischer et al. | 416/224 |
| 4,010,530 | 3/1977 | Degrosso et al. | 416/224 X |
| 4,342,542 | 8/1982 | Tan et al. | 416/224 |
| 4,626,295 | 12/1986 | Sasaki et al. | 228/231 X |

FOREIGN PATENT DOCUMENTS

| | | | |
|---|---|---|---|
| 2004724 | 9/1970 | Fed. Rep. of Germany . | |
| 1146511 | 11/1957 | France . | |
| 2482627 | 11/1981 | France . | |
| 55-60605 | 5/1980 | Japan | 416/224 |
| 0692867 | 6/1953 | United Kingdom . | |
| 833758 | 4/1960 | United Kingdom | 228/263.21 |
| 1096294 | 12/1967 | United Kingdom | 416/224 |
| 1479855 | 7/1977 | United Kingdom . | |
| 2076019 | 11/1981 | United Kingdom . | |

*Primary Examiner*—Robert E. Garrett
*Assistant Examiner*—Joseph M. Pitko
*Attorney, Agent, or Firm*—Sughrue, Mion, Zinn, Macpeak & Seas

[57] ABSTRACT

A protective tip (5) for a titanium steam-turbine blade (1), comprises 28% to 40% TiC, 12% to 26% Cr+Co, 1% to 6% Mo, 3% to 8% Ni 0.3% to 1.5% Cu and a balance of Fe. The tip (5) is brazed to the blade (1) by interposing a copper-based strip (6) having a thickness lying between 7/100 mm and 15/100 mm therebetween, then raising the temperature of the blade (1) and its tip (5) to between 900° C. and 950° C. in a vacuum or inert atmosphere oven. This temperature is maintained for a period of between thirty minutes and seventy-five minutes, and the oven is allowed to cool to ambient temperature. Optimal brazing also serves to harden the tip (5) possesses very good resistance to abrasion by water droplets.

3 Claims, 1 Drawing Sheet

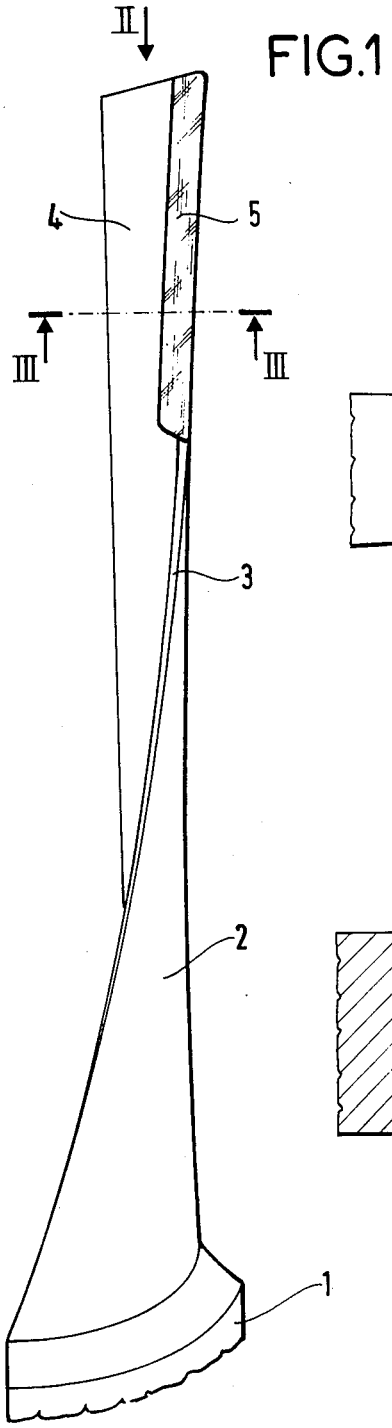
FIG.1
FIG.2
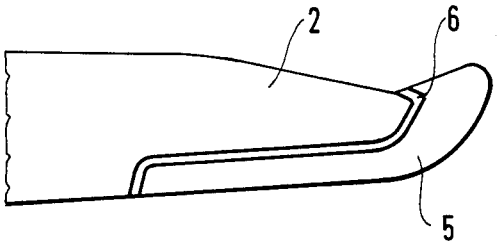
FIG.3
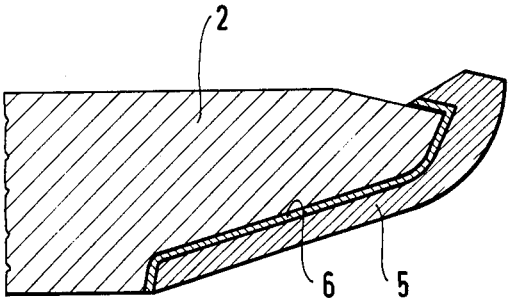

PROTECTIVE TIP FOR A TITANIUM BLADE AND A METHOD OF BRAZING SUCH A TIP

The present invention relates to a protective tip for a turbine blade made of titanium alloy.

BACKGROUND OF THE INVENTION

Titanium alloy blades for steam turbines are particularly advantageous for the last, low-pressure stages where the blades must be of large size. However, in such last stages, the steam includes water droplets which strike the moving blades whose peripheral speeds are high.

SUMMARY OF THE INVENTION

In order to protect the leading edges of the blades, tips are welded or brazed to said leading edges, said tips comprising the following constituents:

TiC: 28% to 40%
Cr+Co: 12% to 26%
Mo: 1% to 6%
Ni: 3% to 8%
Cu: 0.3% to 1.5%
Fe: balance Titanium carbide has the same coefficient of expansion and the same shear modulus as titanium. The binder is constituted by cobalt and chromium which have high intrinsic resistance to erosion and by nickel which improves the ductility of the assembly.

The iron provides the base matrix in which titanium carbide is integrated without difficulty.

The structure of the tip is a nickel martensite having high resistance to wear by virtue of the presence of chromium and cobalt, and relatively high toughness by virtue of the presence of nickel.

The invention also relates to a method of brazing the tip characterized in that it comprises the following steps:

the tip is placed on the blade and a copper-based strip having a thickness lying between 7/100 mm and 15/100 mm is interposed therebetween;

the temperature of the blade and its tip is raised to between 900° C. and 950° C. in a vacuum or inert atmosphere oven and this temperature is maintained for a period of between thirty minutes and seventy-five minutes; and the temperature is cooled to ambient.

By virtue of this method, the brazing between the blade, the copper-based strip, and the tip is simultaneous and optimum. Further, the titanium carbide is at least partially put into solution, thereby conferring a hardness of greater than 50 HRC to the tip.

If the tip is to have a hardness greater than 60 HRC then the temperature is raised, after cooling down to ambient, to 450° C. to 500° C. and maintained for four to six hours prior to being lowered back to ambient. This additional stage puts substantially all of the titanium carbide into solution and simultaneously provides stress-relieving heat treatment.

BRIEF DESCRIPTION OF THE DRAWING

An embodiment of the invention is described by way of example with reference to the accompanying drawing, in which:

FIG. 1 shows a titanium carbide tip in accordance with the invention fixed to a blade;

FIG. 2 is a plan view of the FIG. 1 blade; and

FIG. 3 is a section through the FIG. 1 blade.

MORE DETAILED DESCRIPTION

The steam turbine blade shown in FIG. 1 comprises a root 1 and a twisted vane 2 having a leading edge 3 and a trailing edge 4. A tip 5 is placed along the leading edge 3 of the blade near its top and over its convex surface. This tip extends over about one-third of the width of the blade 2. A copper-based strip 6 is placed between the blade and the tip (see FIGS. 2 and 3).

The blade is made of titanium alloy and the tip 5 has the following composition:

TiC: 28% to 40%
Cr+Co: 12% to 26%
Mo: 1% to 6%
Ni: 3% to 8%
Cu: 0.3% to 1.5%
Fe: balance Two specific compositions have given good results.

| | TiC | Cr | Co | Mo | Ni | Cu | Fe |
|---|---|---|---|---|---|---|---|
| Composition 1 | 32% | 20% | 0% | 2% | 3% | 1% | Balance |
| Composition 2 | 33% | 14% | 9% | 5% | 6% | 0.8% | Balance |

The tip is obtained by sintering and mechanically compacting powder followed by machining. The length of the tip is equal to the length of the blade portion to be protected (up to 500 mm), its width is adequate, it is plane or curved in shape, with or without angles or rounding, in order to fit the shape of the leading edge of the blade.

The machining must be performed with sufficient accuracy for the residual play between the blade 2 and the tip 5 to be never greater than 1/10 mm.

The blade 2 is then prepared and the tip 5 is brazed onto the blade 2 by interposing a copper-based strip 6 therebetween, said strip having a thickness lying in the range 7/100 mm to 15/100 mm.

In order to perform the brazing operation, the blade 2 is placed in an oven together with the tip 5 which is held in place by two or three molybdenum clamps.

The temperature is raised to a temperature between 900° C. and 950° C. This temperature is maintained for thirty minutes to seventy-five minutes depending on the thickness of the leading edge of the blade, and then the oven is allowed to cool to ambient temperature.

In addition to brazing, this treatment structurally hardens the tip 5 by putting a considerable portion of the titanium carbide into solution. The tip 5 then has a hardness lying in the range 50 HRC to 55 HRC.

In order to further increase the hardness of the tip 5 it is subjected to the following additional treatment.

The temperature of the oven is raised to the range 450° C. to 500° C. and this is maintained for four hours to six hours, thereby putting substantially all of the titanium carbide into solution. This simultaneously performs stress-relieving treatment.

I claim:

1. A protective tip for a titanium turbine blade, said tip comprising the following constituents:

TiC: 28% to 40%
Cr+Co: 12% to 26%
Mo: 1% to 6%
Ni: 3% to 8%
Cu: 0.3% to 1.5%
Fe: balance 2. A method of brazing a tip according to claim 1 onto a titanium blade, the method comprising the following steps:

the tip is placed on the blade and a copper-based strip having a thickness lying between 7/100 mm and 15/100 mm is interposed therebetween;

the temperature of the blade and its tip is raised to between 900° C. and 950° C. in a vacuum or inert atmosphere oven and this temperature is maintained for a period of between thirty minutes and seventy-five minutes; and the temperature is cooled to ambient.

3. A method according to claim 2, wherein after cooling down to ambient, the temperature is raised to 450° C. to 500° C. and is maintained for four to six hours prior to being brought back down to ambient.

* * * * *